United States Patent [19]

Husman

[11] 4,142,478

[45] Mar. 6, 1979

[54] ULTRASONIC SIGNAL GENERATING DEVICE

[75] Inventor: Robert J. Husman, San Jose, Calif.

[73] Assignee: Sentry Products, Inc., San Jose, Calif.

[21] Appl. No.: 851,927

[22] Filed: Nov. 16, 1977

[51] Int. Cl.[2] ..... B06B 1/10

[52] U.S. Cl. ..... 116/137 A; 116/169

[58] Field of Search ..... 116/169, 137 A, 167, 116/88; 340/277, 276, 279; 42/1 H, 1 G, 1 Z

[56] References Cited

U.S. PATENT DOCUMENTS

| | | | |
|---|---|---|---|
| 788,866 | 5/1905 | Webber | 42/1 H |
| 1,100,846 | 6/1914 | Rombaugh | 116/88 |
| 2,821,955 | 2/1958 | Ehlers | 116/137 A |
| 2,821,956 | 2/1958 | Wold | 116/169 |
| 2,845,697 | 8/1958 | Adler | 116/169 |
| 2,920,604 | 1/1960 | McDonald | 116/137 A |
| 3,028,832 | 4/1962 | Lazzery | 116/137 A |
| 3,077,856 | 2/1963 | Rieth | 116/137 A |
| 3,165,090 | 1/1965 | Smith | 116/137 A |
| 3,189,000 | 6/1965 | Salners | 116/137 A |
| 3,750,131 | 7/1973 | Fletcher | 340/277 |

*Primary Examiner*—S. Clement Swisher
*Assistant Examiner*—Denis E. Corr
*Attorney, Agent, or Firm*—Townsend and Townsend

[57] ABSTRACT

An improved device for generating an ultrasonic signal for use in an area protected by an alarm actuated by an ultrasonic signal. The device includes a tuned, acoustic rod within a cylinder typically about the size of a pen adapted to be worn in a shirt pocket. The device has a spring-actuated hammer which is movable, when triggered, into engagement with the rod to generate an acoustic signal. When the hammer is cocked, it is held in a cocked position by two spaced triggers which must be actuated simultaneously to release the hammer to cause it to move toward and to strike the rod. The cylinder has an opening for indicating the fact that the hammer has been triggered. The device is made so that it cannot be re-cocked without special equipment not available to the public.

2 Claims, 2 Drawing Figures

ULTRASONIC SIGNAL GENERATING DEVICE

BACKGROUND OF THE INVENTION

1. Field of Invention

Figure 1:
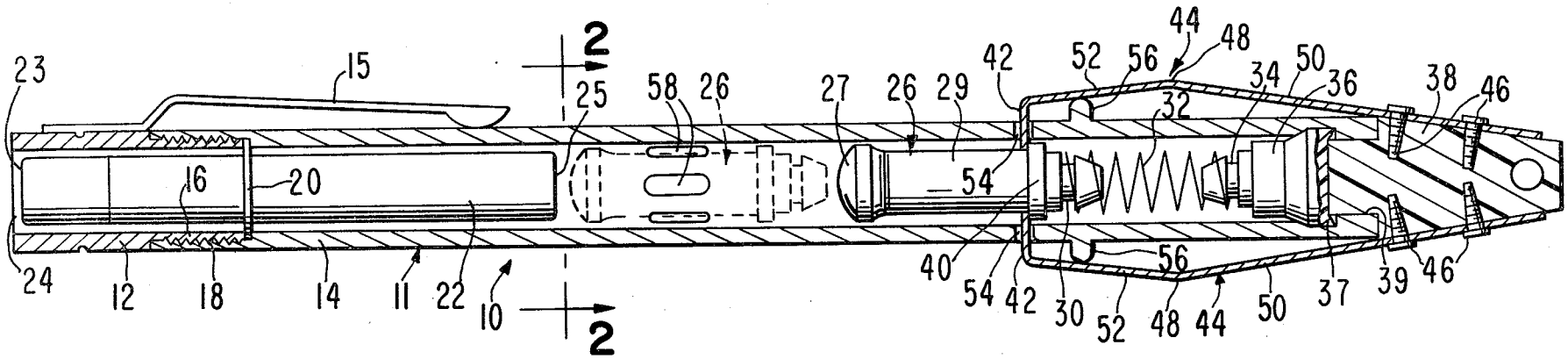

This invention relates to an emergency security system and, more particularly, to an improved acoustic alarm system suitable for use by the general public.

2. Description of the Prior Art

In many emergency situations, such as in cases of violence, it is desirable to discreetly summon immediate aid. Such conditions may arise in large office buildings, in educational institutions, in subway stations, in penal institutions, in hospitals, or in any other area susceptible to violence, the threat of violence or where it is otherwise particularly desirable to remotely trigger an emergency alarm.

Remotely triggered emergency alarm systems have been provided for schools, hospitals, penal institutions and the like. U.S. Pat. No. 3,750,131 discloses a suitable remotely actuated emergency alarm system using acoustic energy for the use and protection of selected institutional personnel. The system has acoustic detectors at various locations and these detectors are coupled to a central control station from which aid may be sent to the indicated locations. Members of institutional staffs may be equipped with a small concealable ultrasonic transmitter which, when hand-actuated by the individual staff member, discreetly signals the occurrence of an emergency to the nearest hidden acoustic detector and thereby relays an alarm to the central control station.

However, the particular concealable transmitter disclosed in the above patent is suitable only for use by trained, responsible personnel. The transmitter is too readily triggered by the untrained user; thus, it can be accidentally triggered too easily. This shortcoming could produce frequent false alarms. Furthermore, use of the transmitter disclosed by the above patent is subject to abuse by the general public because the transmitter can be readily re-cocked and re-triggered. Such a transmitting device might too readily be used to intentionally create false alarms within the system, thus reducing its effectiveness and causing confusion.

SUMMARY OF THE INVENTION

This invention provides a concealable ultrasonic transmitter device which is suitable for use by the general public in an area protected by a remotely triggerable alarm system. The ultrasonic transmitter device according to the invention includes a tuned, acoustic rod mounted within a cylinder resembling a pen of the type that can be carried in a shirt pocket. The device includes a spring-actuated, single discharge hammer which, when triggered, travels toward and against the rod to cause it to emit an acoustic signal. The trigger mechanism includes a pair of spaced triggers which must both be actuated to release the hammer so that accidental actuation only of one trigger will not release the hammer. Typically, the triggers are located so that the device must be held between two fingers (normally the thumb and forefinger) to trigger the hammer.

The device has one or more holes through the cylinder for viewing the position of the hammer, after it has been triggered. Thus, the person carrying the device can readily determine whether or not the hammer is cocked or has been triggered.

The parts of the device are assembled and held in place in a manner such that the hammer, once it has been triggered, cannot be re-cocked by the user. Special equipment not available to the public must be used to re-cock the hammer.

The primary object of this invention is to provide an improved ultrasonic transmitter device similar in size and shape to a writing pen, wherein the device can be triggered only once by the intended user after which the device must be cocked by special equipment before it can be triggered again. Thus the device is substantially immune from abuse due to frequent, unintentional triggering.

A further object of this invention is to provide an ultrasonic transmitter device of the type described which has a double trigger to guard against accidental triggering.

A still further object of this invention is to provide a device of the type described which has openings in the housing thereof to permit veiwing of the hammer after it has been triggered so that the user can immediately determine the cocked or triggered condition of the hammer.

Other objects of this invention will become apparent as the following specification progresses, reference being had to the accompanying drawing for an illustration of the device.

In the drawings

Figure 2:
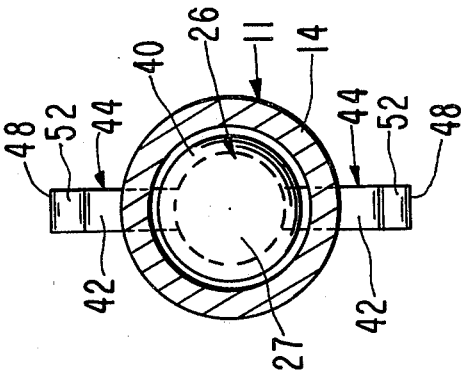

FIG. 1 is a cross-sectional view of the transmitter device according to the invention; and FIG. 2 is a cross-sectional view taken along line 2—2 of FIG. 1.

The ultrasonic transmitter device of the present invention is broadly denoted by the numeral 10 and includes a generally cylindrical casing 11 formed of two threadably interconnected sections 12 and 14. Device 10 is of a size and shape similar to that of a writing pen and resembles such a pen. Thus, the device is suitable for insertion in a garment pocket and is unobtrusive when so worn. A clip 15 on section 12 holds device 10 in a garment pocket.

Section 12 is shorter than section 14 and has an externally threaded end 16 attached to the adjacent internally threaded end 18 of section 14. This attachment confines and supports a thin suspension ring 20 inasmuch as the ring is held between the end face of section 12 and an internal, annular, flat face within the end of section 14.

Ring 20 is secured to a generally cylindrical, metallic vibrator rod 22, the ring being intermediate the ends of the rod. The ring provides a relatively free suspension for vibrator rod 22 so that the latter is spaced inwardly from the inner surface of casing 11 and does not touch the casing at any location. The dimensions of vibrator rod 22 are chosen so that its resonant frequency is above the audible range. Each end of vibrator rod 22 is flat and one end 23 is adjacent to open end 24 of section 12. The opposite or inner end 25 is positioned in the path of travel of a shiftable hammer 26 so that end 25 will be struck by the head 27 of the hammer when the latter moves from right to left when viewing FIG. 1. When the hammer head strikes end 25, vibrator rod 22 is free to ring or resonate for a finite period of time, since the rod is damped only by a small amount of friction from ring 20.

Head 27 is at one end of a generally cylindrical main body 29 of the hammer, the latter being movable axially within casing 11. To this end, the hammer is spaced inwardly from the inner surface of the casing and has a groove 30 at the end opposite to head 27 so that one end of a coil spring 32 can be wrapped in the groove and thereby be coupled to the hammer. The opposite end of spring 32 is received within a groove 34 on a fixed post 36 coupled to a plug 38 extending into the adjacent open end 39 of section 14 of casing 11. Spring 32 is under compression when the hammer is cocked as hereinafter described.

Post 36 is secured in any suitable manner, such as by an enlarged annular flange 37 complementally received within a recess on the inner surface of section 14 near end 39 thereof. Post 36 is preferably made of a resilient material to facilitate the insertion of flange 37 into the recess.

Hammer 26 has an annular flange 40 adjacent to groove 30. Flange 40 is adapted to engage the legs 42 of a pair of flat leaf springs 44, the opposite end of springs 44 being secured by screw fasteners 46 to plug 38 as shown in FIG. 1. Each spring 44 has a peak 48 defining integral segments 50 and 52, segment 50 being attached by screws 46 to plug 38. Legs 42 of springs 44 extend through and are shiftable in diametrically opposed holes 54 through section 14 of casing 11.

Segments 52 of springs 44 normally engage projections 56 on the outer surface of section 14 so that the projections define fulcrums for pivoting segments 52 when inward finger pressure is applied to spring 44 in the vicinity of peaks 48 thereof. When this occurs, legs 42 move outwardly of casing 11 and out of engagement with flange 40 to release the hammer. Spring 32, being under compression when hammer 26 is cocked, then urges the hammer toward rod 22 until the hammer strikes flat end 25 of rod 22, thereby generating an acoustic signal. FIG. 1 illustrates in dashed lines the equilibrium position of the hammer after it has traveled toward and has struck the vibrator rod. Projections 56 can be separate from each other or can form parts of an annular boss on section 14.

Section 14 is provided with a number of spaced slots 58 therethrough substantially midway along the length of device 10. These slots are in the casing between end 25 and the cocked position of hammer 26; thus, if the hammer is in the dashed line (equilibrium) position, the hammer can be viewed through the slots. The slots permit the user to determine whether or not the device has been triggered.

In operation, assuming the hammer is in the cocked position, the user can actuate the device by applying finger pressure simultaneously to springs 44 at peaks 48 to cause segments 52 of the prings to pivot or rock about projections 56. When this occurs, legs 42 move out of the path of travel of flange 40 on hammer 26 and the compression force of spring 32 propels hammer 26 toward vibrator rod 22. The hammer strikes the vibrator rod to cause it to ring and thereby generate an acoustic signal at its resonant frequency. This signal is propagated through open end 24 and through the atmosphere to a suitable detector which triggers an alarm at a control station remote from the place of actuation of device 10.

In the dashed line or equilibrium position of hammer 26 (FIG. 1), the hammer head is spaced from vibrator rod 22 to allow the rod to ring freely without being damped by engagement with the hammer. The compression force of spring 32 is sufficient to advance hammer 26 far enough to the left of the dashed line position of FIG. 1 to cause the hammer to strike vibrator rod 22, yet once the hammer strikes the rod 22, the hammer will rebound a short distance and remain spaced from the vibrator rod.

After the hammer has been triggered and is in the dashed line position of FIG. 1, it can be viewed through slots 58. Preferably, the interior and exterior color of section 14 of casing 11 is different from the color of hammer 26 to provide a contrast therebetween. Thus, the user can more readily determine whether or not the hammer has been triggered. Slots 58 can be covered with a transparent plastic sleeve mounted on section 14 to keep dirt out of casing 11.

To secure device 10 against unauthorized tampering, such as attempting to re-cock the hammer after it has been triggered, section 12 is sealed to section 14 with a suitable sealing material at the junction of ends 16 and 18. Also, flange 37 (FIG. 1) is sufficiently snug in the corresponding recess on the inner surface of section 14 to resist entry to the casing to gain access to the hammer. Thus, with these structural features, it is virtually impossible to tamper with the device and re-cock the hammer without special equipment, thereby guarding against the abuse of the use of device 10 by triggering the device and causing false alarms. After device 10 has been triggered, it can only be re-cocked by special equipment not available to the public.

Device 10 is completely self-contained and has no circuitry or batteries. The use of the device enables the user in a protected area to summon help discreetly in an emergency. The double trigger mechanism provided by springs 44 allows the user to easily trigger the device, yet the springs minimize the risk of inadvertent actuation which would result in a false alarm. Also, the device may be triggered only once. Thus, it is not subject to abuse by those who would intentionally create false alarms. It thus may be provided to the general public and untrained personnel for use in various types of emergencies.

I claim:

1. An acoustic transmitter device comprising: a tubular casing having a pair of interconnected sections, a first of the sections having an open end; a vibrator rod having a natural frequency and a pair of opposed, flat ends, said rod being provided with a ring thereon intermediate the ends thereof, said ring being coupled to the casing at the junction of the sections to suspend the vibrator rod in inwardly spaced relationship to the casing with one end of the rod near the open end of said first section so that, when the other end of the rod is struck, the rod will generate an acoustic signal at its natural frequency; a hammer in the second section and movable therethrough from a cocked position spaced from the vibrator rod, said hammer having an annular flange thereon intermediate the ends thereof; a coil spring within the second section and having one end coupled with the hammer and the opposite end secured to the second section, said coil spring being under compression when the hammer is in said cocked position; and a pair of leaf springs, each leaf spring being rigidly connected at one end thereof to the second section at a location thereon diametrically opposed to the connection of the other leaf spring, each leaf spring having an end leg, the second section having a hole for shiftably receiving each leg, respectively, the legs shiftably extending though respective holes and across the path of travel of the flange on the hammer for engaging and releasably holding the flange and the hammer in said cocked position, said second section having projection means thereon adjacent to and intermediate the ends of each leaf spring, respectively, for engaging the leaf spring and defining a fulcrum therefor, the leaf springs being yieldable toward the second section when manual pressure is applied to the leaf springs to cause pivoting of each leaf spring about its fulcrum to cause the corresponding leg to move outwardly of the respective hole and out of the path of the flange on the hammer to thereby permit release of the hammer and allow movement of the latter toward said triggered position and into striking engagement with the other end of the vibrator rod, the triggered position of the hammer after it has struck the vibrator rod being spaced from the vibrator rod, said second section having a slot therethrough for viewing the hammer when the latter is in the triggered position, said casing being sufficiently imperforate to prevent access to the interior of the casing so as to prevent immediate re-cocking of the hammer after it has been triggered.

2. A device as set forth in claim 1 wherein each leaf spring is peaked to define a pair of angularly disposed segments, one of the segments engaging the adjacent fulcrum.

* * * * *